United States Patent [19]

Leland

[11] 4,284,216

[45] Aug. 18, 1981

[54] SOCK DONNING ASSIST DEVICE

[76] Inventor: Ragnvald G. Leland, P.O. Box 4174, Palm Springs, Calif. 92263

[21] Appl. No.: 515

[22] Filed: Jan. 2, 1979

[51] Int. Cl.[3] ..... A47J 51/06; A47G 25/04

[52] U.S. Cl. ..... 223/111

[58] Field of Search ..... 223/111, 112; 24/3 R, 24/256

[56] References Cited

U.S. PATENT DOCUMENTS

| | | | |
|---|---|---|---|
| 3,993,228 | 11/1976 | Fuhr | 223/111 |
| 4,066,194 | 1/1978 | Leland | 223/111 |

FOREIGN PATENT DOCUMENTS

| | | | |
|---|---|---|---|
| 2602200 | 7/1977 | Fed. Rep. of Germany | 223/111 |

*Primary Examiner*—Louis Rimrodt

*Attorney, Agent, or Firm*—Michael T. Platt; Stanford W. Berman; Irwin M. Aisenberg

[57] ABSTRACT

An improved device for assisting one in the donning of a sock, stocking, or like foot covering. The device comprises a handle member from which laterally and transversely depend a pair of sock expanding and holding members which are adapted to be placed within a sock to spread same for permitting easy entry of the foot of a user. An improved control bar extends between the wire-like handle members and permits the spacing between same to be adjustable to any of a plurality of distances, correspondingly varying the distance between the sock engaging members. An auxiliary holding member may be provided for facilitating use of the device by an amputee.

6 Claims, 11 Drawing Figures

FIG. 1.
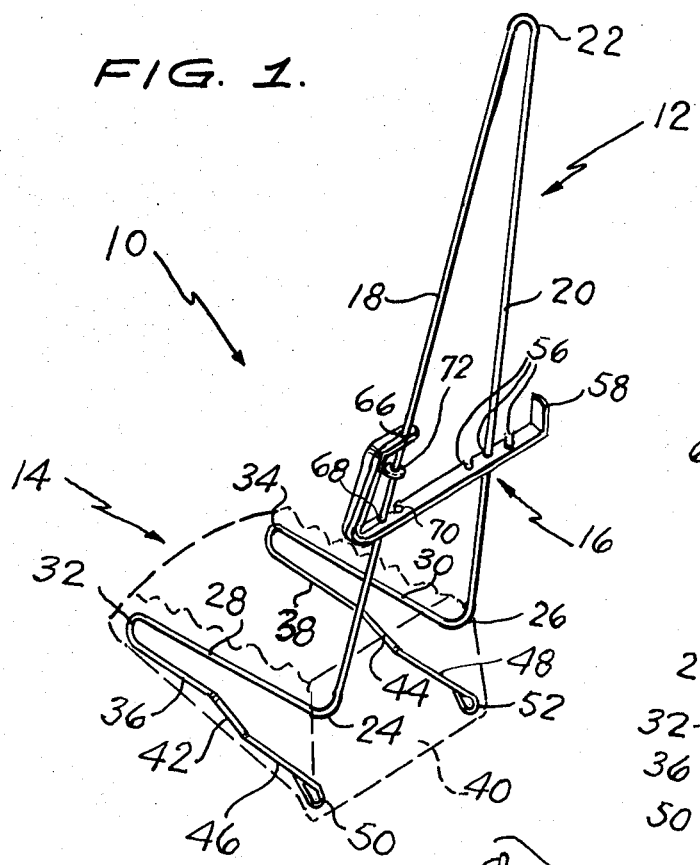
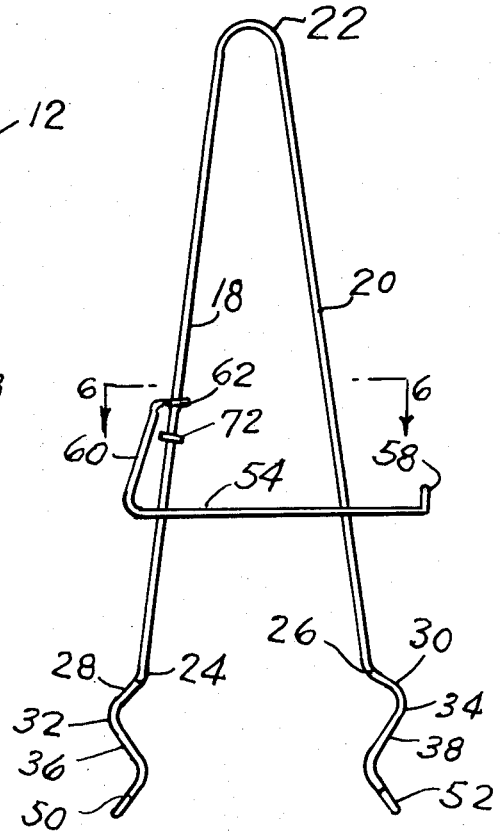
FIG. 2.
FIG. 3.
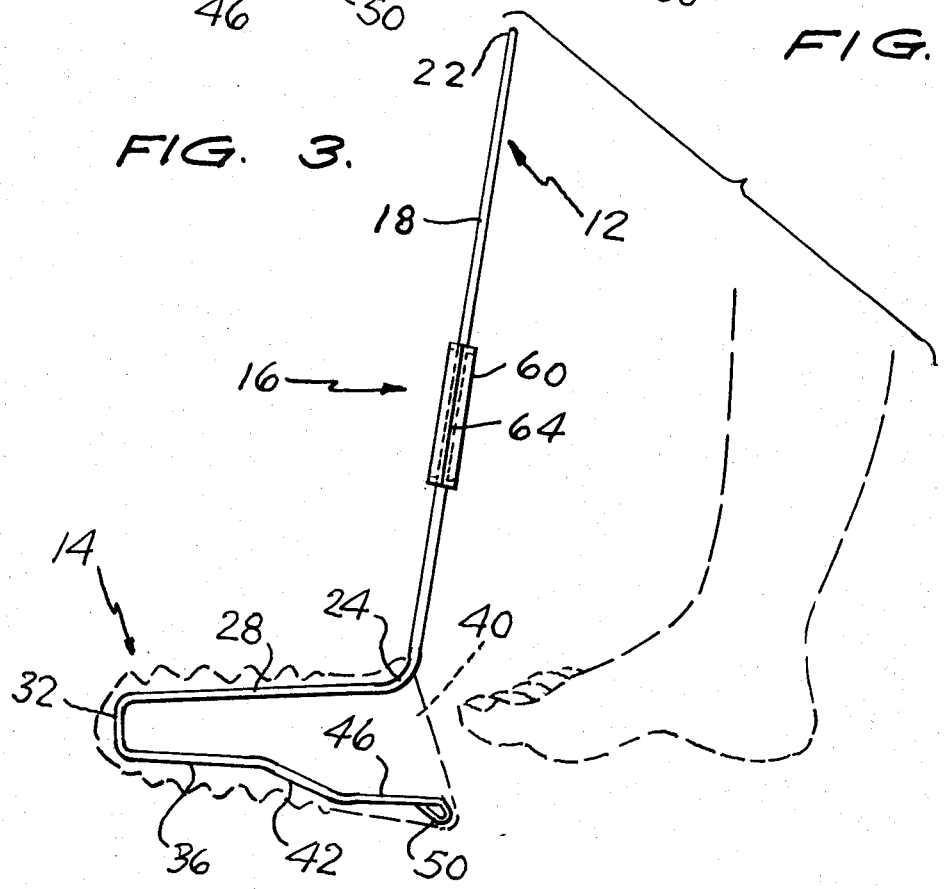

SOCK DONNING ASSIST DEVICE

BACKGROUND OF THE INVENTION

1. Field of the Invention

The present invention relates to a sock donning assist device and, more particularly, to a new and improved device which enables a handicapped or infirm individual to put on a sock, stocking, or similar foot covering with great ease.

2. Description of Related Art

In my previous U.S. Pat. No. 4,066,194, issued Jan. 3, 1978, I describe a sock donning assist device which is a great improvement over like devices of the prior art. The latter includes the following United States Pat. Nos.: 1,315,096; 2,796,207; 2,828,057; 2,919,840; 3,070,271; 3,231,160; 3,452,907; 3,604,604; 3,692,217; 3,715,065; 3,727,812; 3,806,008; 3,853,252; and 3,860,156. Known prior art also includes Italian Pat. No. 717,012 and Swiss Pat. No. 343,094.

As stated above, the devices described in my earlier U.S. Pat. No. 4,066,194, while being a great improvement over the prior art, nevertheless suffers from several deficiencies. A major deficiency of my own earlier device is that it is extremely difficult for an arm amputee to easily operate the device. Since the device was designed to assist such handicapped persons I felt a need to improve same to enable a person having only one hand to more easily employ same.

Another disadvantage of my earlier device is that the means utilized to maintain the handle and insert members in a spread condition was unduly complicated, and somewhat unstable. After using the device for some time, it became clear to me that improvement in this area was also called for.

Another general disadvantage of my earlier design related to the overall arrangement and relative angular positioning of the components, which made use thereof somewhat more difficult than should be necessary. For example, the opening to the sock should be as wide and high as possible for facilitating entry of one foot, and the sock release means should smoothly and automatically release the sock without requiring undue manipulation.

It is towards overcoming the above-noted disadvantages of my own previous design that the present invention has been advanced.

OBJECTS AND SUMMARY OF THE INVENTION

It is therefore a primary object of the present invention to provide a new and improved device for assisting an individual in the donning of a sock, stocking, or like foot covering which overcomes all of the disadvantages noted above with respect to my own previous design.

Another object of the present invention is to provide a novel and unique device for assisting an individual in donning a foot covering, such as a sock or stocking, which is particularly designed to enable use by an individual having only one hand.

A further object of the present invention is to provide a sock donning assist device which more easily releases the sock from the device than previous designs.

Another object of the present invention is to provide an improved sock donning assist device which is simple in construction, easy to operate, may be inexpensively manufactured, and is sturdier than similar devices heretofore available.

A still further object of the present invention is to provide an improved sock donning assist device which provides greater ease of foot insertion and sock installation than previous devices of a similar nature.

The foregoing and other objects are attained in accordance with one aspect of the present invention through the provision of an improved device for assisting in the donning of a foot covering, which comprises handle means, insert means extending integrally from the handle means and adapted to be placed within a foot covering for spreading same, and means operatively coupled to the handle means for selectively maintaining the insert means in one of a plurality of spaced apart positions.

More particularly, the means operatively coupled to the handle means includes first means for maintaining the insert means relatively close together, and second means for maintaining the insert means relatively wide apart. The handle means more particularly comprises a pair of laterally spaced, elongated frame members, and the means operatively coupled to the handle means comprises a control bar pivotally mounted to one of the frame members. The first and second means more particularly comprise first and second notch means formed in the control bar for selectively releasably retaining the other of the frame members therein. The handle means may further include spring means connecting the elongated frame members at one end thereof for normally urging the insert means apart to spread the foot covering positioned thereover. The first notch means is positioned adjacent the one frame member during the initial installation of the foot covering thereon, while the second notch means is positioned adjacent the free end of the control bar for maintaining the foot covering in a spread position during donning.

In accordance with other aspects of the present invention, the control bar comprises a first transversely extending portion within which the first and second means are formed, a grip portion extending integrally vertically from the first portion, and a pivot portion extending transversely from the grip portion and also being pivotally coupled to the one frame member.

The insert means may comprise a pair of foot covering insert frames, each consisting of an upper frame member and a lower frame member, which in repose extend angularly away from one another from their point of connection to the handle means, thereby providing an automatic sock engaging action. Each of the lower frame members terminate in a rearwardly positioned foot covering holding device which extends downwardly and outwardly from the respective lower frame members to maintain a wide and deep opening in a foot covering to facilitate insertion of the user's foot.

In accordance with another important aspect of the present invention, there may be further provided holder means for permitting use of the device with one hand by, for example, an arm amputee. The holder means may comprise a spring device adapted to hold the sock donning assist device on the leg of a user while the sock is being initially placed thereon. The spring device in a preferred embodiment comprises a substantially U-shaped spring member adapted to be fitted over the thigh of the user to hold the sock donning assist device by engaging the handle means.

BRIEF DESCRIPTION OF THE DRAWINGS

The foregoing and other objects, aspects, uses and advantages of the present invention will be more fully appreciated as the same becomes better understood from the following detailed description of the present invention when considered in connection with the accompanying drawings, in which:

FIG. 1 is a perspective view which illustrates a preferred embodiment of the present invention;

FIG. 2 is a rear view in elevation of the preferred embodiment illustrated in FIG. 1;

FIG. 3 is a side view of the preferred embodiment illustrated in FIGS. 1 and 2, diagramatically illustrating a sock on the device and the foot of a user;

DETAILED DESCRIPTION OF THE PREFERRED EMBODIMENT

Figure 4:
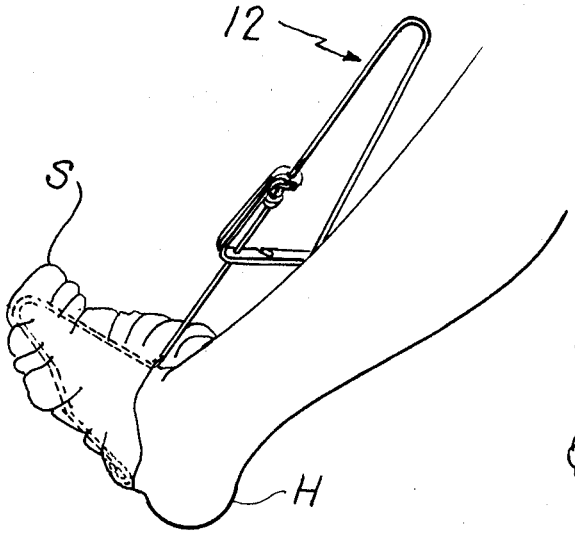
FIGS. 4 and 5 illustrate the steps involved in utilizing the device of the present invention.

Referring now to the drawings, wherein like reference numerals represent identical or corresponding parts throughout the several views, and more particularly to FIG. 1 thereof, the improved sock donning assist device is therein indicated generally by reference numeral 10.

Sock donning assist device 10 includes a handle portion indicated generally by reference numeral 12, a sock expanding and gripping portion indicated generally by reference numeral 14, and a control portion which is indicated generally by reference numeral 16.

Handle portion 12 preferably comprises a pair of wire-like side frame members 18 and 20 which are joined at their upper end by a spring-imparting end member 22. Members 18 and 20 diverge from end member 22 towards their lowermost bent portions 24 and 26, respectively.

The sock expanding and gripping portion 14 comprises a pair of upper arms 28 and 30 which respectively extend integrally from lower bent portions 24 and 26 of side frame members 18 and 20. Upper arms 28 and 30 diverge from bent portions 24 and 26, for a purpose which will become more clear hereinafter.

From the distal ends of upper arms 28 and 30 extend downwardly projecting end portions 32 and 34 respectively, from which respectively integrally extend rearward lower arms 36 and 38, respectively. Arms 36 and 38 are preferably in the same vertical plane as upper arms 28 and 30, respectively, but form somewhat of an angle therewith, taking into account the end portions 32 and 34.

In order to provide a wider opening 40 for the foot of a user, a pair of downwardly bent portions 42 and 44 may extend from the lower arms 36 and 38, respectively. From bent portions 42 and 44 extend rearwardly into terminal portions 46 and 48, respectively. While portions 46 and 48 may be respectively parallel with upper arms 28 and 30, it should be appreciated that, if desired, portions 36, 42 and 46, as well as portions 38, 44 and 48, may be made straight but at an angle with respect to upper arms 28 and 30 respectively.

At the end of terminal portions 46 and 48 are respectively formed a pair of sock holder portions 50 and 52. Each of the sock holder portions 50 and 52 comprises a downwardly and outwardly somewhat U-shaped piece of wire which also assists in imparting a wide opening 40 for the foot of a user, as will be explained more fully hereinafter.

As illustrated in greater detail in FIGS. 1, 2, 3, 6, 7 and 8, control portion 16 comprises a substantially flat control rod or bar 54 which is of a length at least as wide as the widest opening desired for the sock extending and gripping portion 14. The control bar 54 is, in a preferred form, planar and includes at the free end thereof a plurality of notches 56 formed therein which are adapted to receive and retain side frame 20. A finger grip 58 may extend upwardly from the free end of control bar 54 adjacent the position of notches 56 for facilitating manipulation by a user.

Extending upwardly from the other end of control bar 54 is a side member 60 which may be utilized as a hand grip. From the top of side member 60 transversely extends a fastening pivot member 62. The control portion 16 is pivotally coupled to side frame member 18 by providing pivot holes 66 and 68 in pivot member 62 and one end of control bar 54, respectively. The control portion 16 may be installed on side frame member 18 by providing a cut or slit 64 from aperture 66 to aperture 68 along pivot member 62, side member 60, and control bar 54.

Figure 6:
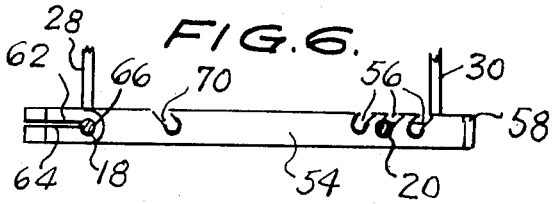
FIG. 6 is a cross-sectional view of the preferred embodiment illustrated in FIG. 2 and taken along line 6—6 thereof.

As indicated in FIG. 6, another notch 70 may be formed in control bar 54 at a position adjacent that of side frame member 18, for a purpose which will become more clear hereinafter. Side member 60 may be selectively positioned along the length of side frame member 18 by proper positioning of a rubber washer 72 or the like.

Figure 7:
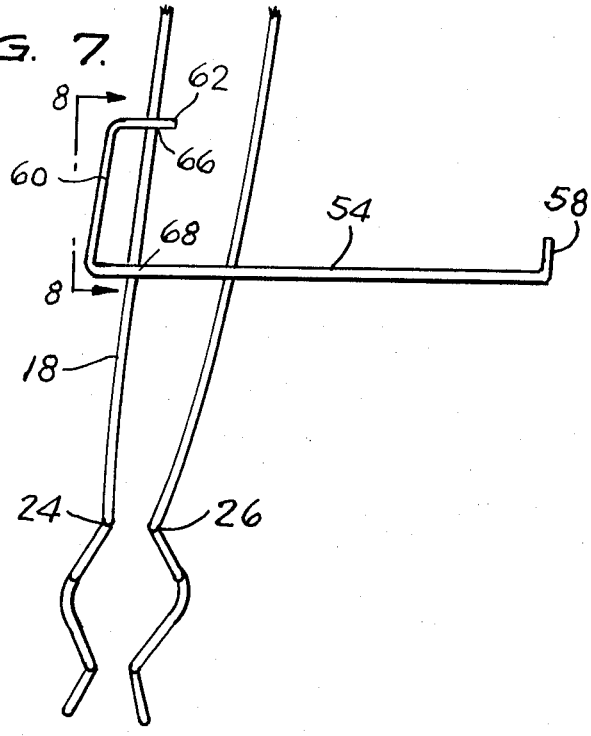
FIG. 7 is a fragmentary view illustrating the lower portion of the device of the present invention in an initial operative position.
Figure 8:
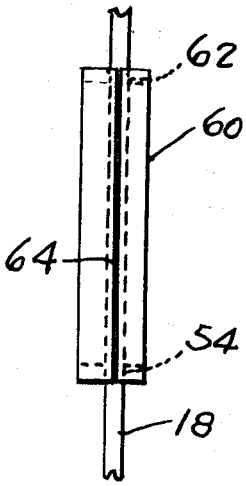
FIG. 8 is an enlarged, side view of a portion of the preferred embodiment of the present invention which is taken along line 8—8 of FIG. 7.

In utilizing the device of the present invention, a user having two hands may pull the gripping portion 14 together by grasping bent portions 24 and 26 and pulling same towards one another to the position illustrated in FIG. 7. With the other hand, the sock may be pleated and placed over the sock expanding and gripping portions 14 until the rearmost portion thereof is embraced by the sock holder portions 50 and 52. The divergence of upper and lower frame members 28, 30 and 36, 38 automatically grips the front closed portion of the sock S, while the holder portions 50 and 52, in combination with bent portions 24 and 26, maintain the open end of the sock on the device and provide a wide opening 40 for insertion of the foot of the user.

The user may then release bent portions 24 and 26 and may secure the right frame member 20 within one of the notches 56, as may be selected in accordance with the size of the sock and the foot of the user. At this point, the device is essentially in the state illustrated in FIG. 1.

Figure 5:
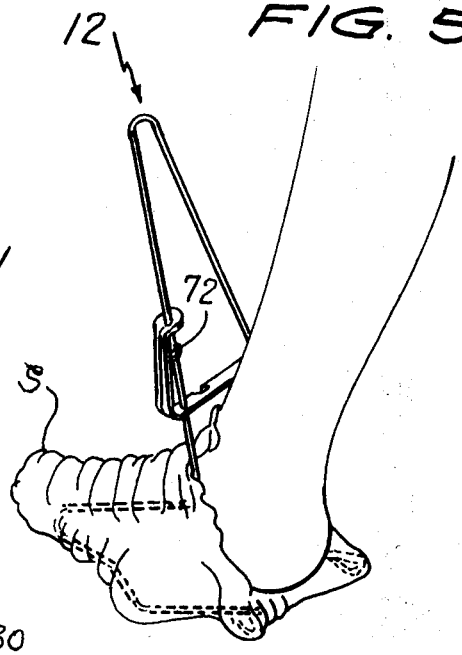

A user then grasps the handle portion 12 and slips his foot into the wide opening 40 until it reaches the closed end of the sock. In the position illustrated in FIG. 4, the sock S is about to be placed around the heel H by rotating the handle 12 from the position of FIG. 4 to that of FIG. 5. No force or effort is required in this manipulation, and the sock S may then be easily slid over the heel and up the ankle and thigh of the user. At the conclusion of the operation, due to the rounded edges of sock holder portions 50 and 52, the latter simply glide out of the end of the sock, leaving the latter securely and properly in place. The control bar 54 may be released at the conclusion of the operation by swinging same so that side frame member 20 is released from notch 56. This may facilitate removal of the device from the sock at the conclusion of the operation.

Figure 9:
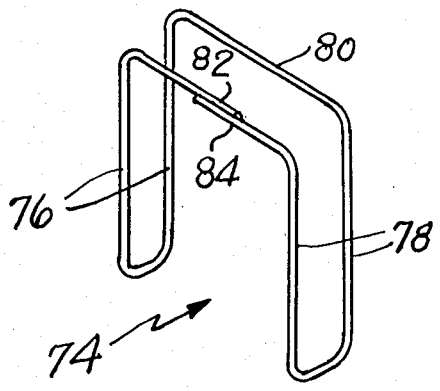
FIG. 9 is a perspective view which illustrates an auxiliary holding device of the present invention.
Figure 10:
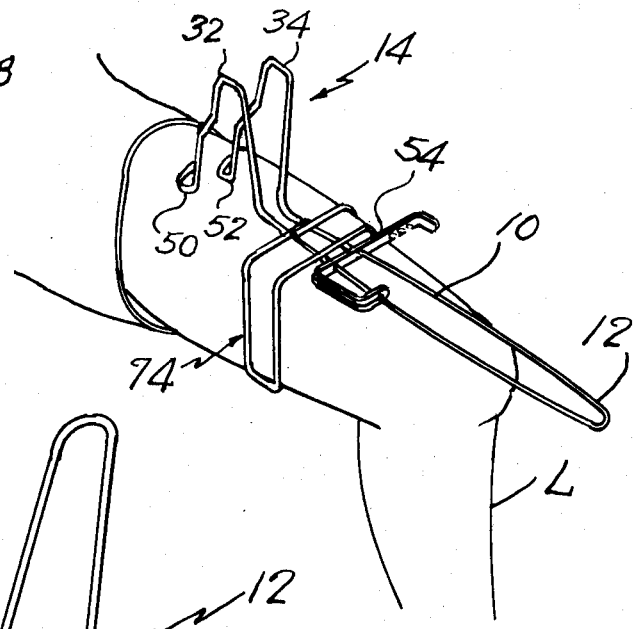
FIG. 10 is a diagramatic illustration of how the holding device of FIG. 9 and the preferred embodiment of FIG. 1 may be utilized.

Referring now to FIG. 9, reference numeral 74 indicates generally an auxiliary spring member which is adapted to be positioned about the leg of one who has but one hand for using the device of the present invention, such as an arm amputee. The auxiliary spring member 74 comprises a pair of substantially parallel, U-shaped projections 76 and 78 which are adapted to grip the sides of the user's thigh, as illustrated in FIG. 10. Projections 76 and 78 are connected by a transverse member 80, and free ends 82 and 84 may be provided for adjusting the spring action of the unit for various individuals.

FIG. 10 illustrates how the auxiliary spring member 74 of FIG. 9 could be utilized by an amputee having only one hand. Such a person initially grips the lower bent portions 24 and 26 and pulls same together to the position illustrated in FIG. 7. Side frame member 20 will then automatically drop within notch 70 in control bar 54 for maintaining this position without requiring the user to hold bent portions 24 and 26.

With the auxiliary spring member 74 in position on the leg L of the user as illustrated in FIG. 10, the handle portion 12 of the device 10 is placed between spring member 74 and the upper portion of the user's thigh in such a fashion that sock expanding and gripping portion 14 faces the user. Auxiliary spring member 74 therefore simply serves as a means for holding the device 10 while a one-armed user pleats the sock over the divergent arm members of portion 14. After the sock is initially placed over sock expanding and gripping portion 14 with one hand, bar 54 may be swung out of position to release side frame member 20 from notch 70. The user may reengage side frame member 20 in a notch 56 by manipulating finger grip 58 (FIG. 6).

The user may then release the handle portion 12 from the auxiliary spring member 74, and may then manipulate the device of the present invention in the same fashion described above for installing the sock S on his foot. The auxiliary holding spring member 74 is adjustable to fit differently sized legs, and the position of control portion 16 may be vertically adjusted along side frame members 18 and 20 with the aid of rubber washer 72.

Figure 11:
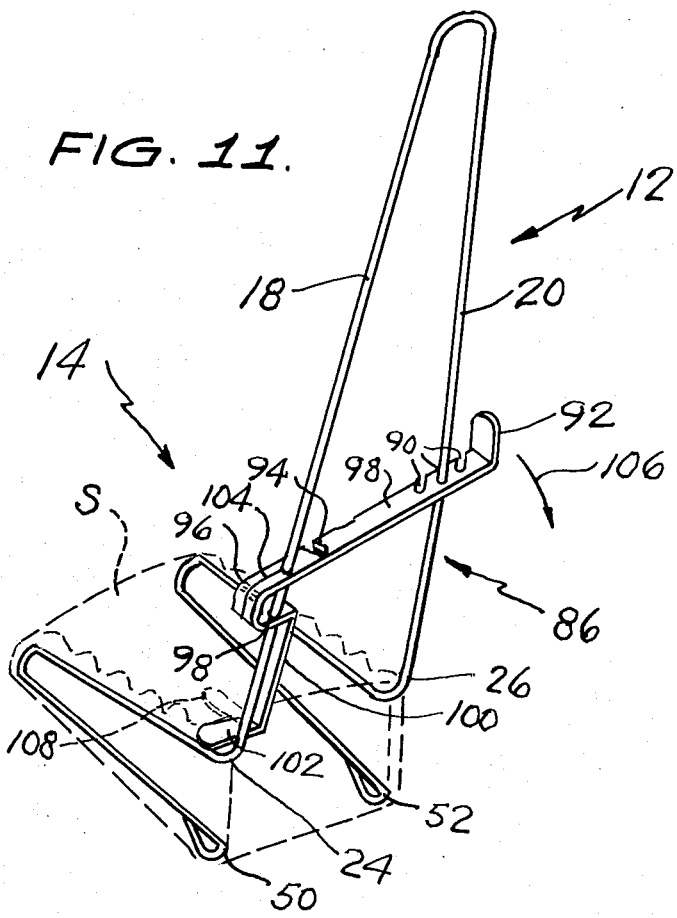
FIG. 11 illustrates a modified control bar in accordance with an alternate embodiment of the present invention.

Referring now to FIG. 11, there is illustrated an alternate embodiment of the present invention which utilizes a different form of separator or control bar, which is indicated generally by reference numeral 86. Handle portion 12 and sock insert and gripping portion 14 may be substantially identical to the embodiment described hereinabove.

The control portion 86 in this embodiment is designed to include an automatic sock release feature, similar to that set forth in my earlier U.S. Pat. No. 4,066,194. More particularly, control portion 86 may include a transversely extending control rod or bar 88 which is preferably planar and includes a plurality of notches 90 positioned on the front edge thereof and adapted to receive wire rod 20 of handle portion 12. A finger grip portion 92 may extend vertically from the end of bar 88 adjacent the position of notches 90.

At the other end of bar 88 is positioned a downwardly extending side portion 96 from the lower portion of which extends a transverse member 98. The end of bar 88 and transverse portion 98 are both pivotally mounted to wire frame member 18 of handle portion 12. A slit 104 may be provided to facilitate insertion onto the wire member 18.

Extending downwardly from transverse portion 98 is leg 100 which is substantially parallel with rod 18. Leg 100 extends to a position just below bent portion 24. Extending laterally from leg 100 is a sock gripping member 102 which functions in addition to sock holding portions 50 and 52 to hold the sock S prior to donning.

A notch 94 may be positioned on bar 88, in a position and for a function similar to that of notch 70 with respect to the first embodiment described above.

In operation, the sock S is initially placed over the insert portion 14 and around the holder portions 50, 52 and 102. After the sock S has been fully positioned on the leg of the user, substantially as described hereinabove with respect to the first embodiment, the control rod 88 is pivoted about rod 18 in the direction indicated by arrow 106. This pivotal movement rotates member 102 to the position indicated in dotted outline by reference numeral 108, which is in a direction parallel to the sock retaining members 14. This serves to automatically release the sock S from the device 10 of the present invention, in a manner analogous to that described in my earlier patent.

Obviously, numerous modifications and variations of the present invention are possible in light of the above teachings. It is therefore to be understood that within the scope of the appended claims, the invention may be practiced otherwise than as specifically described herein.

I claim as my invention:

1. An improved device for assisting in the donning of a foot covering, which comprises:

handle means being a pair of laterally spaced, elongated frame members;

insert means extending integrally from said handle means and adapted to be placed within a foot covering for spreading same; and means operatively coupled to said handle means for selectively maintaining said insert means in one of a plurality of spaced apart positions, said means operatively coupled to said handle means being a control bar pivotally mounted to one of said frame members, said means operatively coupled having first means for maintaining said insert means relatively close together and second means for maintaining said insert means relatively wide apart, said first and second means respectively comprise first and second notch means formed in said control bar for selectively releasably retaining the other of said frame members therein.

2. The device as set forth in claim 1, wherein said handle means further comprises spring means connecting said elongated frame members for normally urging said insert means apart.

3. The device as set forth in claim 2, wherein said first notch means is positioned adjacent said one frame member while said second notch means is positioned adjacent the free end of said control bar.

4. The device as set forth in claim 1, wherein said control bar includes a first transversely extending portion within which said first and second means are formed, a grip portion extending integrally vertically from said first portion, and a pivot portion extending transversely from said grip portion and also being pivotally coupled to said one of said frame members.

5. The device as set forth in claim 1, wherein said insert means comprises a pair of foot covering insert frames, each comprising an upper frame member and a lower frame member, which in repose extend angularly away from one another from their point of connection to said handle means.

6. The device as set forth in claim 5, wherein each of said lower frame members terminate in a foot covering holding device which extends downwardly and outwardly from the respective lower frame members to maintain a wide and deep opening in a foot covering to facilitate insertion of a user's foot.

* * * * *